US005123213A

United States Patent [19]

Vinson

[11] Patent Number: 5,123,213

[45] Date of Patent: Jun. 23, 1992

[54] TWO STAGE CENTERLESS GRINDERS

[76] Inventor: Paul Vinson, Box 4020, Saint Simons Island, Ga. 31522

[21] Appl. No.: 652,065

[22] Filed: Feb. 7, 1991

[51] Int. Cl.[5] ..... B24B 5/18

[52] U.S. Cl. ..... 51/103 WH; 51/103 R; 51/165.77; 51/165.9; 51/215 R; 51/215 UE; 51/238 GG; 51/326; 51/103 TF

[58] Field of Search ..... 51/2 K, 2 UA, 103 R, 51/103 WH, 103 TF, 165.77, 215 AR, 215 R, 215 UE, 238 R, 238.66, 238 S, 326, 327, 165.76, 165.85, 165.9, 165.92

[56] References Cited

U.S. PATENT DOCUMENTS

| | | | |
|---|---|---|---|
| 1,814,367 | 7/1931 | Caster | 51/103 TF |
| 2,033,324 | 3/1936 | Caster et al. | 51/103 R |
| 2,295,342 | 9/1942 | Graf et al. | 51/2 UA |
| 2,741,880 | 4/1956 | Falls | 51/240 A |
| 2,887,829 | 5/1959 | Burridge | 51/103 TF |
| 3,108,407 | 10/1963 | Hughes | 51/103 R |
| 3,115,729 | 12/1963 | Render | 51/103 WH |
| 3,408,773 | 11/1968 | Cole et al. | 51/103 R |
| 3,660,946 | 5/1972 | Thayer | 51/103 WU |
| 3,729,300 | 4/1973 | Mackay et al. | 51/103 R |
| 3,807,098 | 4/1974 | Schaller et al. | 51/165.71 |
| 3,874,128 | 4/1975 | Ishii | 51/103 |
| 4,018,011 | 4/1977 | Whittenberg | 51/236 |
| 4,051,634 | 10/1977 | Fisher | 51/103 R |
| 4,062,150 | 12/1977 | Masuda et al. | 51/5 |
| 4,083,151 | 4/1978 | Jessup et al. | 51/103 R |
| 4,107,881 | 8/1978 | Jessup | 51/103 R |
| 4,178,719 | 12/1979 | Jessup | 51/103 TF |
| 4,192,102 | 3/1980 | Jessup | 51/103 R |
| 4,580,370 | 4/1986 | Smith | 51/289 R |
| 4,783,932 | 11/1988 | Sager | 51/103 |

*Primary Examiner*—Bruce M. Kisliuk
*Assistant Examiner*—John A. Marlott
*Attorney, Agent, or Firm*—Warren F. B. Lindsley

[57] ABSTRACT

A two stage centerless grinder for shaping work pieces wherein each stage comprises a grinding wheel and associated regulating wheel with work supporting means therebetween and a venturi means for feeding the work pieces to the first stage for a first initial grinding operation and to a second stage for a second or finishing operation with means for adjusting the position of the grinding wheels relative to its associated regulating wheel.

3 Claims, 6 Drawing Sheets

TWO STAGE CENTERLESS GRINDERS

BACKGROUND OF THE INVENTION

This invention relates to machine tools and more particularly to a two stage centerless grinder and is related to a commonly owned co-pending U.S. patent application Ser. No. 07/633,075 filed Dec. 24, 1990 and entitled Fixture For Converting Surface And Tool Grinder Into A Centerless Grinder.

FIELD OF THE INVENTION

The present invention relates generally to grinders for producing a wide variety of different kinds of workpieces and particularly to a two stage centerless grinding system wherein the workpieces pass from one stage to another.

DESCRIPTION OF THE PRIOR ART

Centerless grinding is a well known grinding technique in which the workpiece is not held in any centering spindles or chuck, but rather is inserted into the space between the faces of a grinding wheel and an opposed regulating wheel. The bottom of the workpiece is normally supported by a work rest blade which may have an inclined surface so that the vertical position of the workpiece, relative to the centers of the grinding wheel and the regulating wheel, can change without losing the support of the work rest blade. The rotational axis of the workpiece normally remains above the rotational axis of the regulating wheel and the grinding wheel so that the workpiece is also supported by both wheels. Long pieces are sometimes ground below center line to eliminate whipping and warping.

As used herein the regulating wheel is defined as a cylinder driven about its axis of rotation while the surface is maintained in frictional contact with the surface of a workpiece, while the workpiece is being ground, to control the rotational velocity of the workpiece. Ideally, the workpiece turns at exactly the same velocity as the regulating wheel so that no rubbing, and no material removal occurs at the regulating wheel-workpiece interface. To this end the regulating wheel is usually made with a relatively small amount of abrasive having a grain and grade specification different from that of the grinding wheel and generally with a rubber bond. The grinding wheel is always driven at a surface velocity different from that of the regulating wheel so that rubbing action and consequent removal of material occurs at the grinding wheel workpiece interface.

The work holder or rest blade as used herein is a workpiece supporting member, typically used in centerless grinding, to support the bottom of a workpiece positioned between a regulating wheel and a grinding wheel. The top surface of the blade, which is the surface that engages the workpiece, may slope upwardly toward the grinding wheel. The blade is usually at least as long as the workpiece so that the workpiece is supported along its full length.

During a grinding operation the workpiece is braked by the regulating wheel in order to create the relative rubbing contact of the grinding wheel face and the workpiece surface. The grinding wheel and the regulating wheel both rub against the workpiece and tend to drive it clockwise but the regulating wheel is driven at a slower surface velocity than the grinding wheel.

Thus, the regulating wheel acts as a controllable regenerative brake. The regulating wheel not only serves to brake the workpiece and thereby controls its speed, but also serves as a continuous backup support or "steady rest" for the workpiece across the full length of the grinding wheel while the workpiece is being ground. The work rest blade or work support remains fixed during the grinding of any given workpiece but the vertical position of the blade can be adjusted prior to grinding so that the particular workpiece to be ground is located at the desired elevation relative to the axes of the regulating wheel and the grinding wheel. Also, different work rest blades can be used for different sets of workpieces.

Since centerless grinding systems are desirable for grinding extremely small workpieces precisely and with strongly applied machining or grinding forces, it is desirable to utilize a two stage grinding assembly wherein the first grinding station removes the initial metal from the workpiece and the second station provides the polishing grinding effort.

Although a great many patents have been granted on grinders and particularly centerless grinders, none are known which disclose a two stage centerless grinder of the type claimed herein.

U.S. Pat. No. 3,874,128 discloses a centerless workholding apparatus or fixture for holding work in a working position radially and axially relative to a reference axis by use of rolls and an axially and rotatably movable rotor element.

U.S. Pat. No. 4,018,011 discloses a centerless grinder work support and booty roller therefor.

U.S. Pat. No. 4,051,634 discloses a regulating wheel pivot adjusting device for through feed grinding utilizing a means for tilting the axis of the regulating wheel to provide a through feed and further comprises means for elevating the tilt axis to accommodate a range of workpiece diameters without redressing the shape of the regulating wheel.

The following patents relate to centerless patents but are not believed to be pertinent to the grinder disclosed and claimed herein.

| U.S Pat Nos |
|---|
| 4,062,150 |
| 4,083,151 |
| 4,107,881 |
| 4,192,102 |
| 4,178,719 |
| 4,580,370 |
| 4,783,932 |

SUMMARY OF THE INVENTION

In accordance with the invention claimed, a new and improved centerless grinding apparatus is disclosed.

It is, therefore, one object of this invention to provide a two stage centerless grinder which will grind in two stages extremely small workpieces precisely and with strongly applied machining or grinding forces.

Another object of this invention is to provide a two stage grinder wherein the first grinding station employs a single relatively wide grinding wheel and the second station two or more individual narrow band grinding wheels which are bonded together to gradually decrease the coarseness of the cutting abrasive.

A further object of this invention is to provide a new and improved two stage centerless grinder wherein the material removed from the piece being ground from entrance to exit in one pass through the machine is greater than possible with any prior art grinder.

A still further object of this invention is to provide a multi stage centerless grinder wherein the finish of the workpieces ground gradually improves without changing the adjustment of the grinder.

A still further object of this invention is to provide a two or more stage grinder wherein the grinding wheel or wheels of each stage is individually powered.

Yet another object of this invention is to provide a two station centerless grinder that provides individual adjustment and setting not possible with a conventional single stage grinder.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWINGS

The present invention may be more readily described by reference to the accompanying drawings; in which.

DESCRIPTION OF THE PREFERRED EMBODIMENTS

Figure 1:
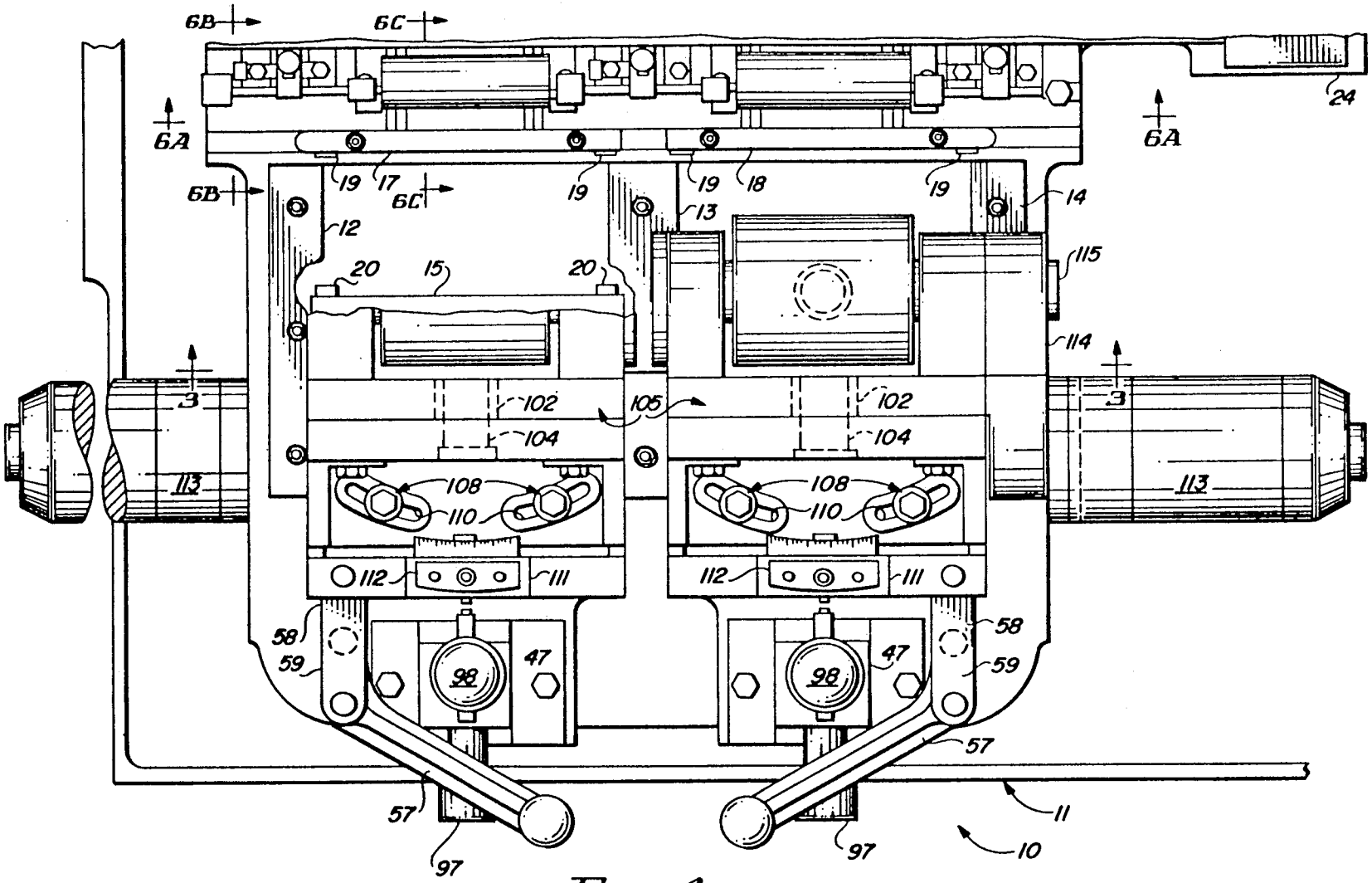
FIG. 1 is a partial plan view of a two stage centerless grinder minus the grinding wheels and their motor and embodying the invention.

Referring more particularly to the drawings by characters of reference, FIGS. 1-6E disclose a two stage centerless grinding machine 10 comprising base 11 which supports on its top two individual slide assemblies or gibs 12, 13 and 14. Between these, in two places, are slides 15 and 16, bottom left (1st stage) and bottom right (2nd stage) of the two stage grinder. Other items attached to bottom slides 15 and 16 will be explained later, including stop key 17 left and stop key 18 right.

Figure 2:
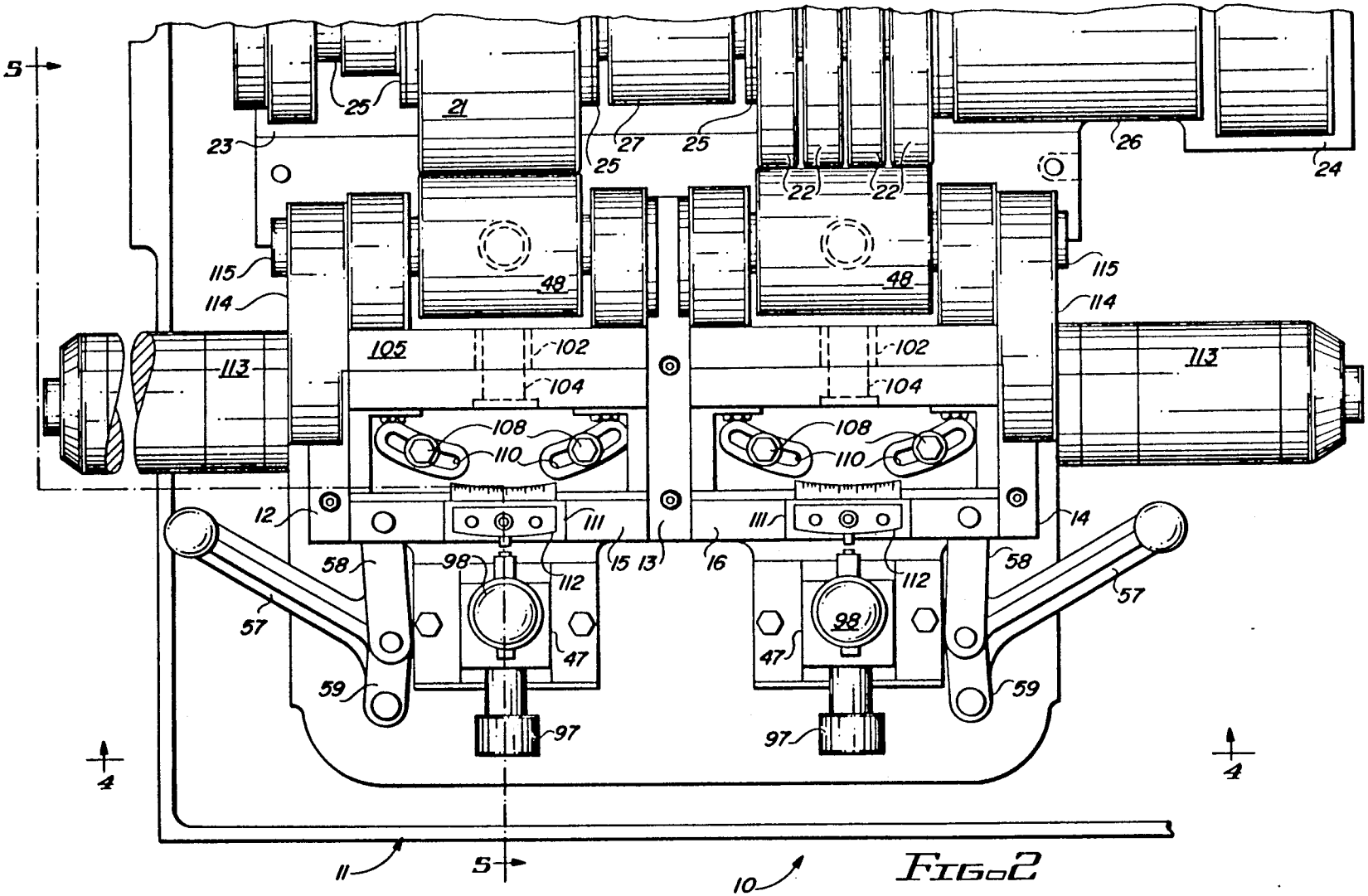
FIG. 2 is also a partial plan view similar to FIG. 1 but showing the grinding wheels.
Figure 3:
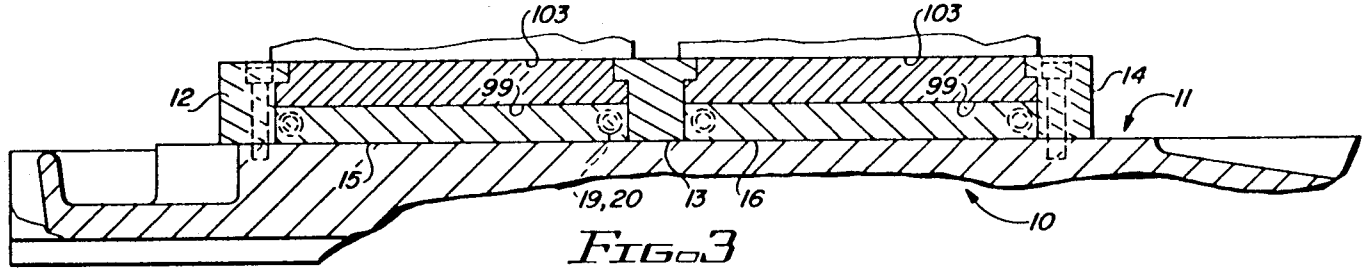
FIG. 3 is a sectional view taken along lines 3—3 of FIG. 1.
Figure 5:
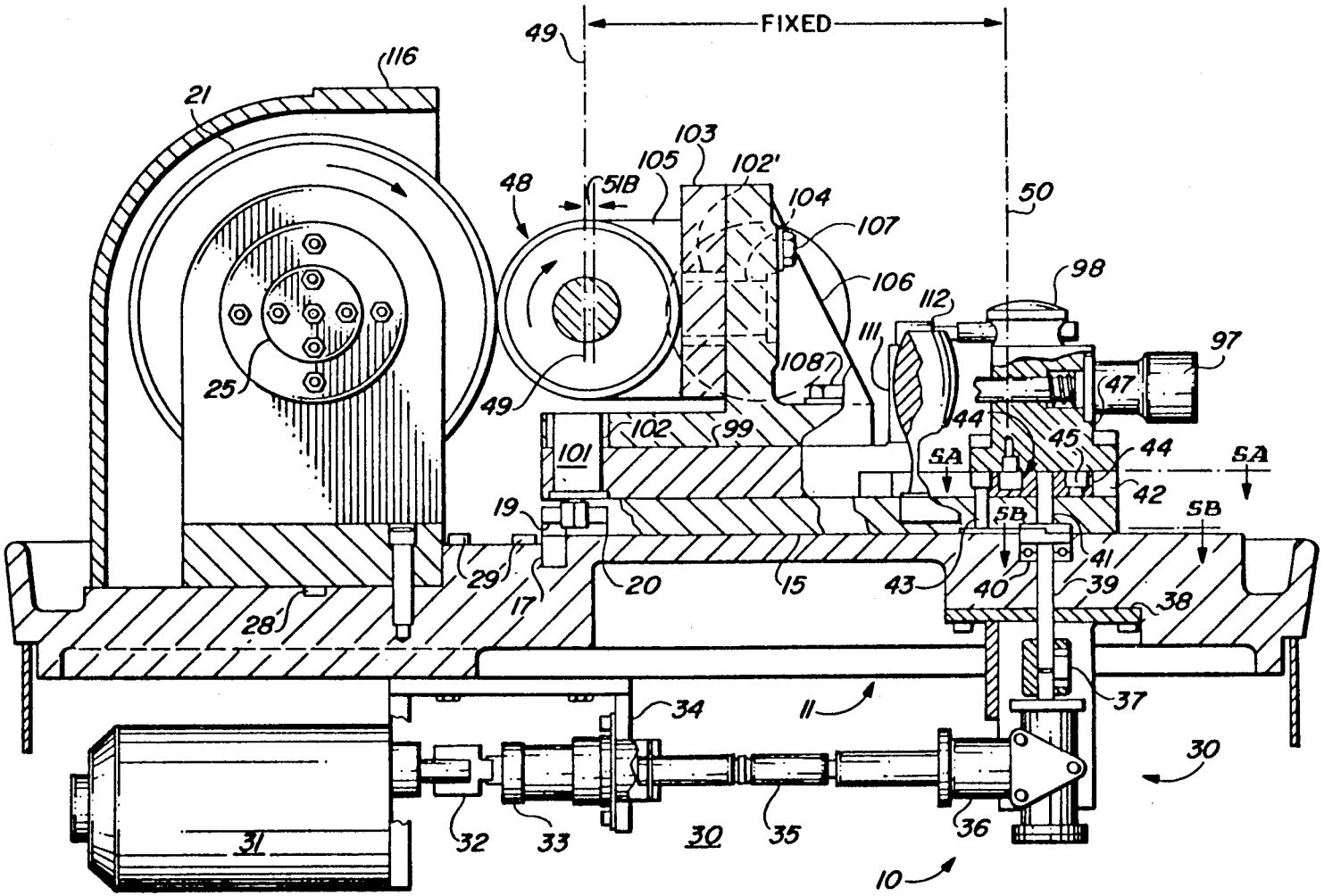
FIG. 5 is a cross sectional view of FIG. 2 taken along the line 5—5 showing the motorized mechanism for cam feed and lock of regulator slides.

Attached to the forward edge of stop keys 17 and 18 are stop buttons 19 and to the forward side of slides 15 and 16 are stop buttons 20, shown on FIGS. 1, 3 and 5. These stop buttons are for the purpose of accurate, repeat stopping of slides 15 and 16. Shown farther to the rear, still on the top of base 11 as shown on FIGS. 2 and 5, are the grinding wheels 21 and 22, stages 1 and 2 respectively. They are supported by tail stock 23, head stock 26 and its associated belt guard 24, shown on FIGS. 1, 2 and 5. Also suspended by the center shaft support 27 and tail stock 23 are the spindle shaft and collar assemblies 25 that the grinding wheels and head stock 26 are affixed to. The shaft assembly is split or segmented between the center shaft support and the head stock, providing a sub assembly of the tail stock, center shaft support, both grinding wheels, main shaft and collar assemblies. This permits quick change of the grinding wheel assemblies and servicing the grinding wheels off of the main machine. Center shaft support 27 supports the above named items. All of items 23, 26 and 27 are rigidly and at fixed positions affixed to base 11 and aligned with key 28. Also located on top of base 11 and just behind key 17, see FIG. 5, are rest buttons 29 that accurately support base plate 61 of the work rest. On the under side of base 11, we have another subassembly 30, that comprises a motorized feed drive and release mechanism, comprised of a variable speed motor 31, connected by shaft and coupling 32 to one revolution clutch 33 with motor 31 and clutch 33 being mounted to the underside of base 11 by bracket 34. The output end of the clutch shaft and coupling 35 attaches to a 90°, 1:1 gear box 36. Out of the gear box 36 extends a vertically positioned coupling 37 that extends through bracket 38 and connects to the lower shaft of a stepped head rotary connector 39. Just below the rotary connector head is a seal and rotary thrust bearing 40. Just above and in line with bearing 40 is the upper portion of a rotary connector 41.

With the exception of connector 41, which is an extension of connector 39, the preceeding described items 12 through 40 are all affixed directly or attached indirectly to either the top or bottom of base 11.

Figure 5A:
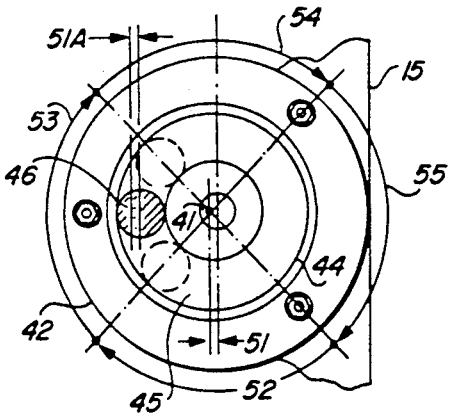
FIG. 5A is an enlarged view taken along the line 5A—5A of FIG. 5.

The upper shaft portion of rotary connector 41 passes through slide 15 and is then affixed to cam 44. Cam 44 is diametrically contained in ring 42 by screws 43 into the top of bottom slide 15. A cam roller or follower 46 travels in eccentric track 45 and roller 46 is attached to the bottom of setting block 47, as shown in FIGS. 5 and 5A.

Cam follower 46 and the center line of regulator roll 48 and its pivot are both on the same centerline and the distance therebetween is fixed as shown at 50 in FIG. 5. The total movement of cam 44, in 360° of the cam revolution is shown at 51 and 51A (in FIG. 5A).

Although the design of the cam and connections, etc., are unique, the versatility in travel, feed, dwell, etc. must be made to suit individual needs. The principle is explained, again in FIG. 5A, whereby the 360° rotation (powered by mechanism 30 up through split heads 39 and 41) could be explained in 4 quadrants. The first quadrant 52 would be a fast forward. The second quadrant 53, would be the actual grind or stock removal. The third quadrant 54 would be the return to start position. The fourth quadrant could be a dwell in the out position 55. Although the combination are practically endless, the preceeding could have covered a complete travel of the regulating roll of 0.030", whereby 52=0.015", 53=0.015", and 54=0.003". The dwell in position 55 would be "0".

It is important to understand in the above explanation of the cam that the first stage could be the same as the second stage, or entirely different with the combinations being practically endless.

Figure 4:
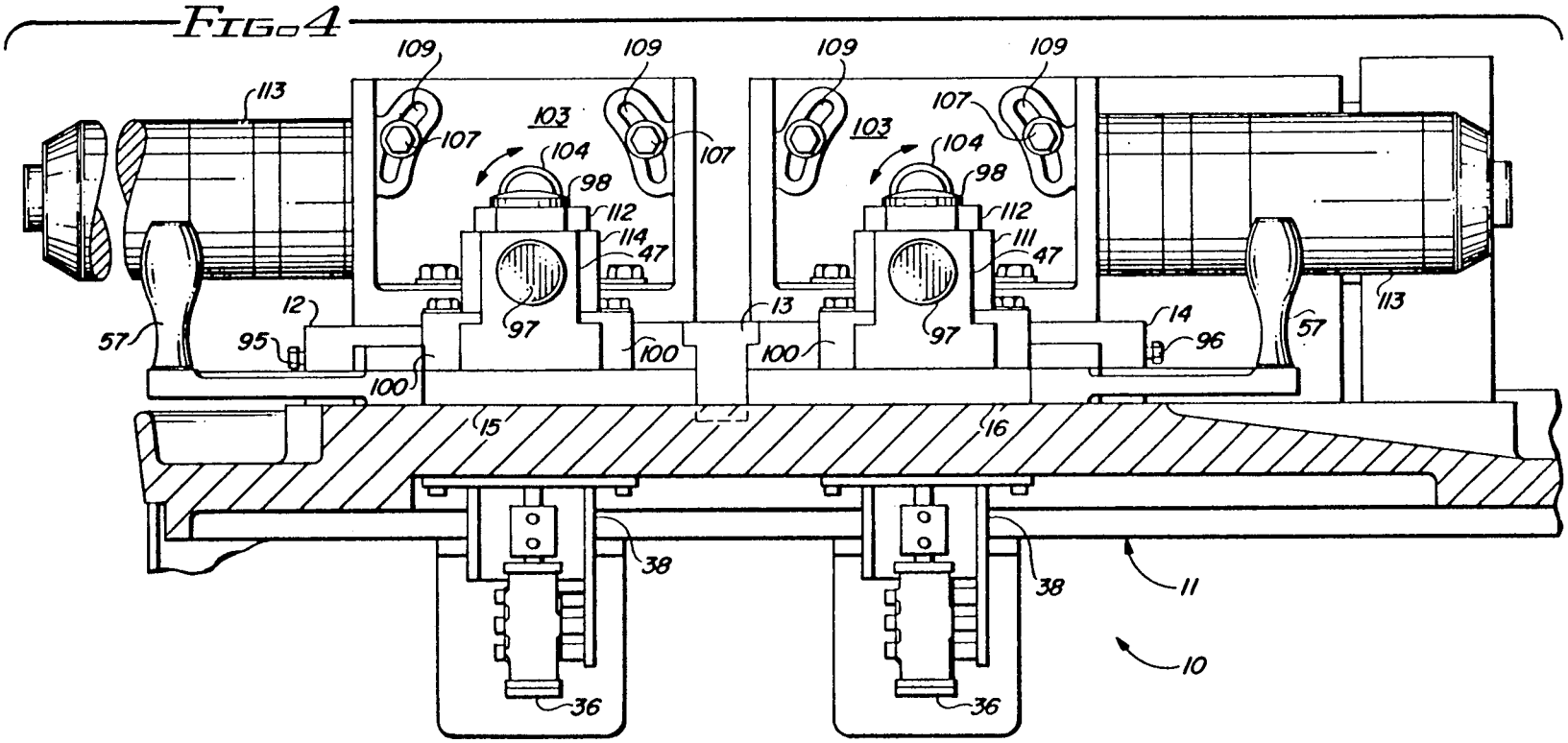
FIG. 4 is a front view of FIG. 2 taken along the lines 4—4.
Figure 5B:
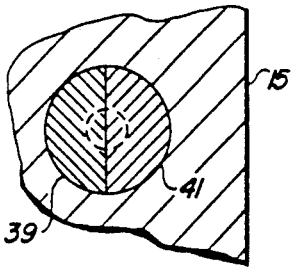
FIG. 5B is an enlarged sectional view taken along the line 5B—5B of FIG. 5, showing the split rotary disengagement design for the lower slide release.

FIG. 5B illustrates a further explanation of the split and/or stepped heads of the lower connector 39 and the upper connector 41. Through this unique design we can disengage the forward position of the lower slide 15 and back it away approximately 3" to facilitate maintenance or inspection of the grinding area or work rest area. Referring to FIGS. 1 and 3, the actuation of block 15 resulting in 3 inch movement can be seen by observing handle 57 in the forward position on FIG. 2 and in the outward position in FIG. 1. This forward and return movement of handle 57, through toggle linkage mechanisms 58 and 59, well known in the art, moves the bottom slide 15 and everything attached to the top surface, including the regulating roll 48. This is all possible by hand force upon the handle 57. The toggle and handle design 57, 58 and 59 has a two fold purpose. In the out position, it allows the handles to be in the more safety angular swing in position, as shown on FIG. 1. In the forward position, it allows the well known toggle locking effect, whereby positive pressure is applied to the rest button contacts 19 and 20 for accurate positioning of slide 15. Toggle stop screws 95 and 96 shown on either side of gibs 12 and 14 of FIG. 4 are used to set the overtravel of the toggle link for locking pressures.

Figure 6D:
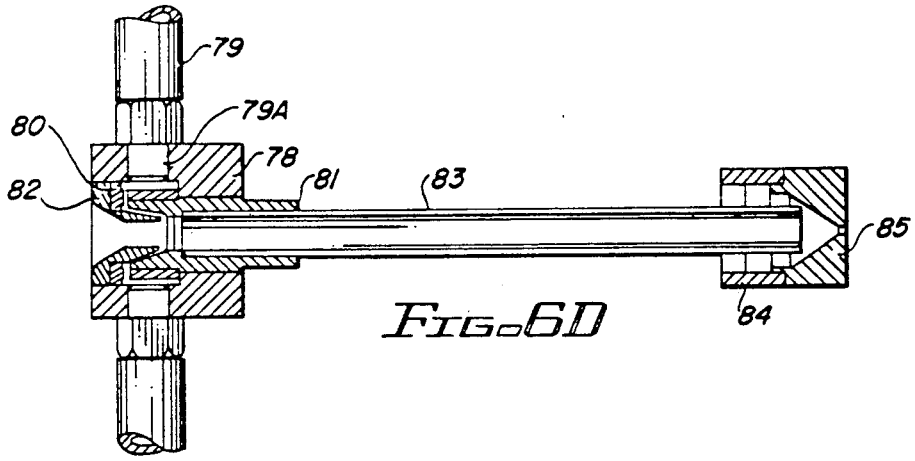
FIG. 6D is an enlarged sectional view through the venturi assembly.
Figure 6E:
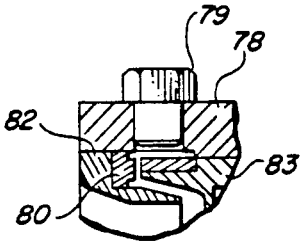
FIG. 6E is another enlarged view of the inlet portion of air passages needed to create the venturi system.
Figure 6C:
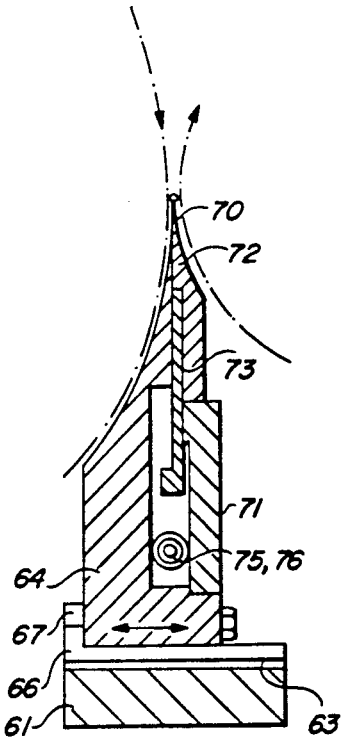
FIG. 6C is a sectional view through the blade support assembly for the workpieces.
Figure 6B:
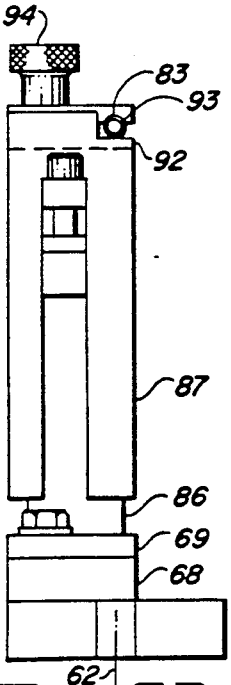
FIG. 6B is a side view of FIG. 6A showing a tower support for the venturi tube.
Figures 6, 6A:
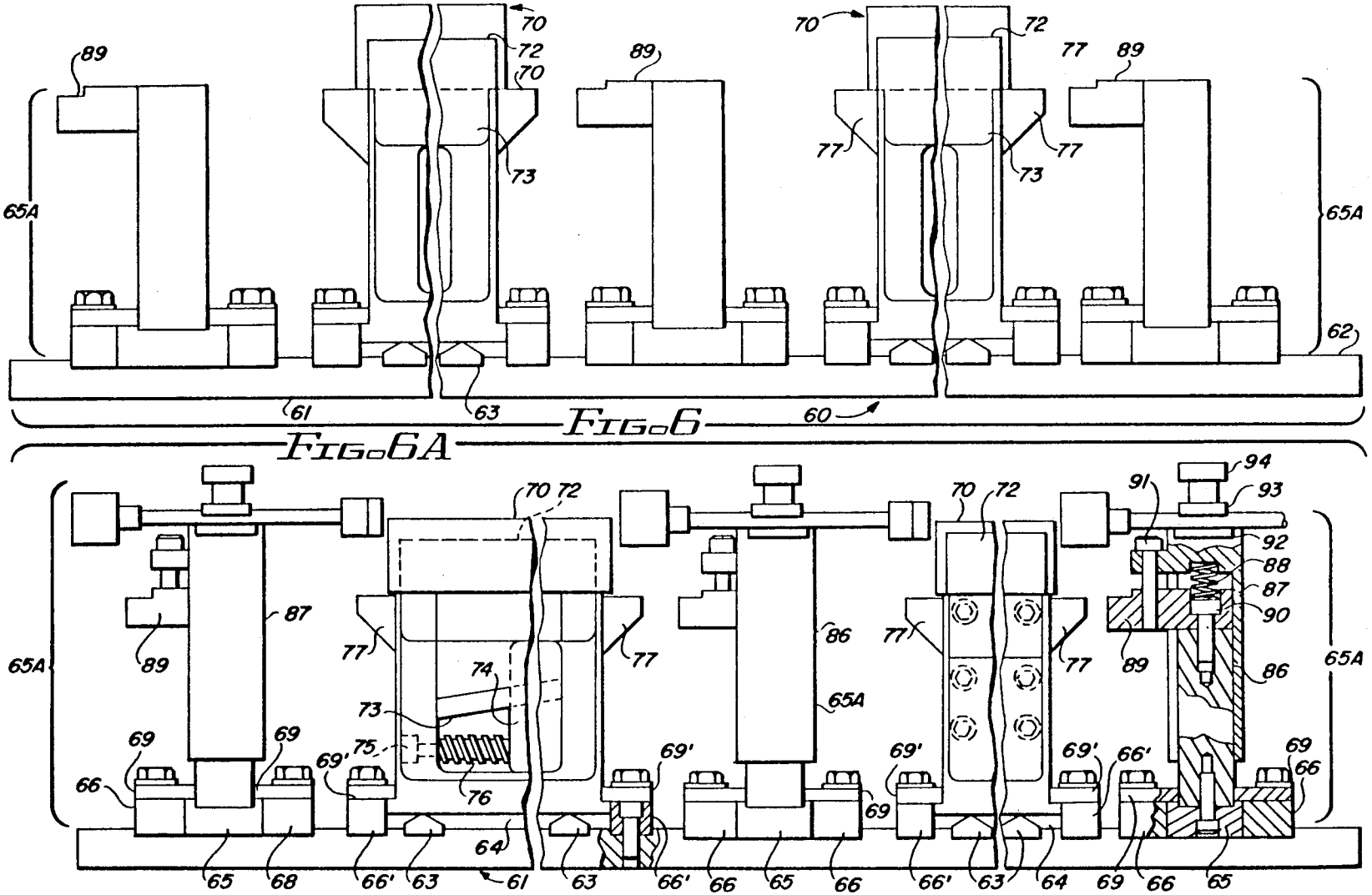
FIG. 6 is a front view of the stock work or piece support unit, without the venturi tubes, removed from the two stage centerless grinder.
FIG. 6A is a view similar to FIG. 6 with the addition of the venturi tubes for automatically handling the workpiece to be ground.

FIGS. 6 through 6E disclose a unit 60 shown separate from the two stage centerless grinding machine which supports, guides and directs the stock or pieces being ground across the grinding wheels and can be easily removed and/or replaced swiftly and accurately on the associated machine as hereinafter explained. Unit 60 comprises a base plate 61 which supports and is used for alignment and fastening thereon other machinemounting surfaces such as rails 63 which accurately support sub-bases 64. Sub-bases 65 support three venturi towers 65A with associate providing rails 66 clamp supports for clamp bars 69.

Confined in rails 66' at two locations are the sub-bases 64 that also act as housings for the support blades 70 and items surrounding them. The rear face of blade 70 is backed up by a vertical extension of sub-base 64 see FIG. 6C. The front face of blade 70 is supported and clamped by backing 72. Underneath backing 72 and intrapped by sub-base 64 is a cover plate 71 as shown in FIGS. 6C. Behind cover plate 71 are the two pieces 73 and 74. Blades 70 are slightly thinner than the workpieces being ground, and are positioned between the grinding wheel and the regulator wheel. These blades support the bottom of the work piece and are raised by cam driven piece 73. The upper surface of blade 70 is straight and parallel to the top and bottom of the blade 73. The bottom of work rest piece 73 is angular and has a rear, parallel angular tang that is at a slight angular slope to the top of piece 73. The piece 73 serves as a workrest blade or wedge. This slight angular slope is in conjunction with a matching female slot in the bottom of piece 74 that closely fits the above male piece blade 73. The rear, female slotted lower piece or wedge 74 is shorter or narrower than workrest blade or piece 73 and when moved back and forth by a horizontally mounted adjustment spring 76 and screw 75 produces a very fine ratio of horizontal to vertical movements, the exact ratio depending on the standard size screw thread selected and the desired angle. For instance, a ratio of 0.005 horizontal to 0.004 vertical can be achieved easily. The above adjustments can be achieved either on or away from the parent grinding machine.

Another feature of sub-base 64 and outboard of each side of stop keys 17 are two reference lands 77 per sub-base 64. These lands afford an accurate means, well known in the art, of inspection and set up, for a dimensional reference of 1.000 inches, from the top of the lands to the periphery of the grinding wheel, that is difficult, if not impossible, to check especially when the set up is away from the parent grinder. This 1.000 inch reference also coincides with the top of the rest blades 70 and the bottom of the workpiece.

Also, resting on top of sub-base 61 at locations confined between rails 66' and under clamp bars 69', are the venturi tube support towers 87. The venturi principle is well known in the art of transfer of parts, etc. or the evacuation of gases.

FIG. 6D illustrates an enlargement of the venturi tube 83 for transferring parts to the grinding wheels. This design is typically used for three areas of the grinding machine. One as an approach for the first stage grinding wheel area with the part being hand fed or hopper fed. The second use of it is between the two grinding stages and the third, or last, use is to remove the workpieces away from the second stage grinding wheel. Only at the last third position is the exterior parts 84 and 85 not needed, unless it is desirable to accurately guide the workpiece instead of blowing them into a container for finished parts or inspection. The tube assembly including items 78 through 85 shown in FIGS. 6D and 6E operates as follows: controlled air enters through one or more hoses 79 and flows through ports 79A into bell assembly or item 78 and passes through a manifold sleeve 80 and through a secondary combination manifold spacer and tapered female orifice and tube receptacle 81. Outboard of the receptacle 81 is item 82 which has two tapers and fits inside tube assembly item 78, against inside manifold sleeve 80 and receptacle 81, but allows a controlled, taper periphery space for the air to pass. This is where the venturi action takes place. The extremely high speed air passing through the small angular passage strikes the stagnant air of the inlet tube 83. This action propels the workpiece along the inside diameter of tube 83. The outboard end of tube 83 is surrounded by a sleeve attachment or part 84 that receives a funnel type part 85 that is interchangeable with an outlet that has an internal diameter sufficient for desirable control guidance of the workpiece when needed.

Each of these subassemblies including items 79 through 85 are mounted on three small tower subassemblies 65A affixed to the sub-bases 65, consisting of items 86 through 94. Post 86 provides a base to set block 89, which are similar to reference lands 77 as previously explained. The only difference here is that the 1.000 inch references are to the center of tubes 83 and the center of the grinding wheels, instead of a reference to the top of the rest blades 70 and the periphery of the grinding wheel as previously explained. Screw 90 attaches set block 89 to post 86 and separated by a compression spring 88 and adjusting screw 91, is an external combination rest for tube rest 92 and forms a lower sliding cover for post 86. On top of venturi tube 83 is an inverted V shaped clamp 93. At the rear of clamp 93 is an elongated slot that provides lateral adjustment for the clamp by loosening clamp screw 94. By utilizing the aforementioned items for adjustment, the venturi tube subassemblies 80–85 can be adjusted and tightened into a variety of positions; fore and aft, right and left, and up and down of the assembly.

Continuing into the front area of FIG. 5, block 47 is attached to top slide 99. This top slide 99 is guided by gibs 100 at each side thereof, see FIG. 4. At the forward end of top slide 99 is a pivot pin 101, in line with regulator roll 48. This arrangement provides a pivot point whereby the regulator roll may be adjusted out of parallel with the fixed center line of the grinding wheels, as seen from the plan or top view of the structure. Around the top of pin 101 is a bushing 102 inside the regulator roll bracket 103. This allows for wear. On the forward side and around the pin 101 is the bushing 102' which is in turn inside a bracket 105.

This bracket is "U"-shaped whereby the center of the "U" is affixed to bushing 102' and pivots on top pin 104, see FIGS. 1, 2, 4 and 5. The "U" shape of each regulator roll bracket 103 is for the purpose of retaining the proper bearings for the accurate and smooth containment of the regulating bearings. The "U" shape is necessary to allow clearance for the regulator roll's cylindrical shape.

The afore-mentioned bracket 103 is a converted "T" shape, to allow for the mountings of pivot pins 101 and 104. As shown in FIG. 5, the ribs on the right side of the inverted "T" at 106 are only for rigidity. Extending through the vertical and horizontal parts of this bracket 103 are two bolts 107 and 108. The bolts 107 pass through radial clearance slots in 110 and are threaded into the base portion of the "U" shaped brackets 105. When the regulator rolls need to be adjusted out of a horizontal alignment position, pivoting on pin 104, these two bolts are loosened then tightened after adjustment has been made.

The shape of regulator roll bracket 103 allows for a similar arrangement of bolts and adjustments, only this time for an out of alignment adjustment in the horizontal plane as explained heretofore for pivot 101. This time bolts 108 provide radial clearance by means of slots 110 and are threaded into top of slide 99 shown in FIGS. 1, 2, 4 and 5.

The remaining two parts that have a physical connection to block 47 and top slide 99 are riser block 111, which has a two fold purpose: i.e., one to provide a platform for item 112, and indicator 98 and second to provide a connection for adjustment knob 97 shown in FIGS. 1, 2, 4 and 5.

The last segment of the apparatus involves motors 113 for the regulator rolls, best seen in FIGS. 1 and 2. As far as basic designs are concerned, it is only the motor mounting that differentiates between the two regulator roll stages. In both cases, the motors and their connections to their respective spindles, are mounted outboard on the left of the first grinding stage and on the right of the second grinding stage. This outboard drive arrangement is the only thing that makes a difference between the two stages.

The offset mounting between centerline of regulator rolls in FIGS. 1 and 2 and motors 113, are supported by drive housings 114. These drive housings also cover the drive belts (not shown) that connect the output and input pulleys (not shown) wherein the output is on the motor shafts and the input is on the regulator roll shaft assemblies 115.

The only thing left that really needs no functional explanation, except to tie in a complete picture of items, is wheel guard 116, shown only on FIG. 5 and is a well known necessity for safety purposes.

Although but one embodiment of the invention has been illustrated and described, it will be apparent to those skilled in the art that various changes and modifications may be made therein without departing from the spirit of the invention or from the scope of the appended claims.

What is claimed is:

1. A two stage centerless grinder comprising:

a pair of grinding wheels each rotatably journaled on a base, electric motor means for individually and separately rotating each of said grinding wheels, a pair of regulating wheels, each rotatably journaled on said base with one disposed relative to each of said grinding wheels so as to form between each pair of grinding wheels and its associated regulating wheel an inlet end and an outlet end, a work support located between each pair of grinding wheels and associated regulating wheel adapted to support a workpiece of revolution, said work support comprising a thin blade forming substantially a horizontally positioned edge for supporting the workpiece, and a first means for adjustably mounting said blade for vertical movement for positioning a workpiece resting on said edge in a selected position relative to the axis of rotation of said regulating wheels, said first means comprising a pair of wedges mounted in the same plane one slidable along an edge of the other for moving said blade relative to an associated grinding wheel and regulating wheel for varying the position of the workpiece, a second means for pivoting each of said regulating wheels relative to its associated grinding wheel, and a third means for axially moving a workpiece relative to said first grinding wheel and said first regulating wheel for a first grinding effort and sequentially moving said workpiece relative to said second grinding wheel and said second regulating wheel for a second grinding effort, said third means comprising a venturi tube means for feeding the workpieces sequentially to said inlet end of each stage and out of said outlet end of each stage, the first stage comprising a single, relatively wide grinding wheel, and the second stage comprising two or more individually narrow width grinding wheels which are bonded together to gradually decrease the coarseness of the cutting abrasive.

2. The two stage centerless grinder set forth in claim 1 wherein:

each work support is individually adjustable.

3. The two stage centerless grinder set forth in claim 1 wherein:

said venturi means continuously moves the workpieces in an axial direction while grinding and from said first stage to said second stage and away therefrom.

* * * * *